United States Patent [19]

Duke

[11] Patent Number: 4,924,794

[45] Date of Patent: May 15, 1990

[54] SAIL

[76] Inventor: Terence R. Duke, 9 Lucknow Place, Blockhouse Bay, Auckland, New Zealand

[21] Appl. No.: 265,541

[22] Filed: Nov. 1, 1988

[30] Foreign Application Priority Data

Jun. 29, 1987 [NZ] New Zealand ..... 220881

[51] Int. Cl.[5] ..... B63H 9/06

[52] U.S. Cl. ..... 114/102; 114/103

[58] Field of Search ..... 114/102, 103, 39.1, 114/39.2

[56] References Cited

U.S. PATENT DOCUMENTS

| | | | |
|---|---|---|---|
| 4,064,821 | 12/1977 | Roberts, Jr. | 114/103 |
| 4,649,848 | 3/1987 | Belvedere | 114/103 |
| 4,703,707 | 11/1987 | Anderson | 114/103 |
| 4,766,831 | 8/1988 | Johnston | 114/103 X |

FOREIGN PATENT DOCUMENTS

| | | | |
|---|---|---|---|
| 2085387 | 4/1982 | United Kingdom | 114/103 |

*Primary Examiner*—Sherman D. Basinger

*Attorney, Agent, or Firm*—Young & Thompson

[57] ABSTRACT

In its preferred form the present invention comprises an aerofoil sail having tensioned battens and an internal web structure to maintain an aerodynamically efficient shape.

9 Claims, 4 Drawing Sheets

SAIL

FIELD OF THE INVENTION

This invention relates to the general field of sails, with particular application to aerofoil sails for windsurfers.

OBJECT

It is an object of the present invention to go at least partway towards providing an improved sail, or at least to provide the public with a useful choice.

STATEMENT OF INVENTION

In one aspect the invention provides a sail including two surfaces which in normal use form opposite faces of an aerofoil structure, having resiliently flexible support means associated with the two said surfaces at or about extremities of said support means, such that in normal use an increase in the distance between said extremities of support means associated with a first said surface by straightening of said first surface can cause by said interconnection means a corresponding decrease in the distance between said extremities of support means associated with the second said surface, by bowing of said second surface.

Preferably the resiliently flexible support means are battens extending substantially horizontally behind each surface.

Preferably means are provided for limiting inward collapse of the aerofoil structure, including a structure interposed between the two surfaces to in normal use inhibit bowing of the surfaces inwardly.

In another aspect the invention provides a sail having two resiliently and flexibly supported surfaces interconnected by means whereby straightening of one said surface in normal use causes the other said surface to bow, wherein said interconnecting means includes a line anchored at each end at or about corresponding extremities of said support means associated with each said surface, said line passing movably around an anchored retainer, such that in normal use when a first said surface is straightened, the length of line between said retainer and the end of the line anchored in association with said first surface is increased, and the length of line between said retainer and the other end of the line anchored in association with the second said surface is consequently decreased.

These and other aspects of the present invention will be made apparent in the following examples of preferred embodiments.

PREFERRED EMBODIMENTS

Figure 1:
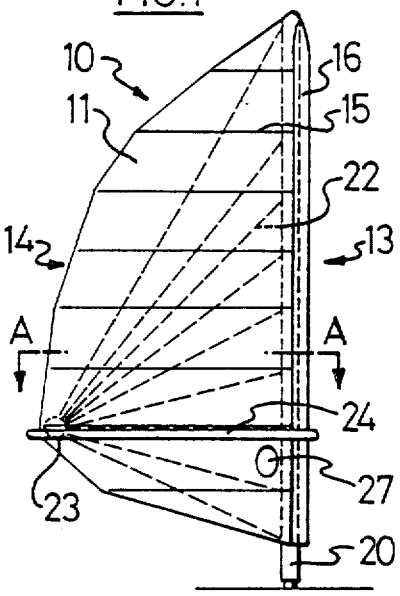

The following is a description of preferred forms of the invention, given by way of example only, with reference to the accompanying drawings, in which:

FIG. 1: shows a preferred sail of the present invention in side view.

Figure 2:
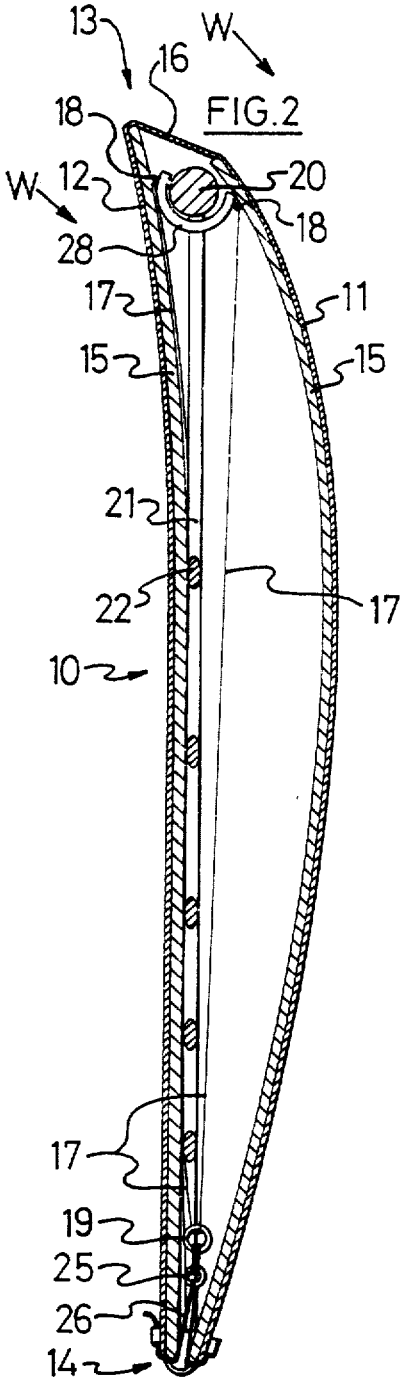

FIG. 2: shows the sail of FIG. 1 in plan view, sectioned along line A—A.

Figure 3:
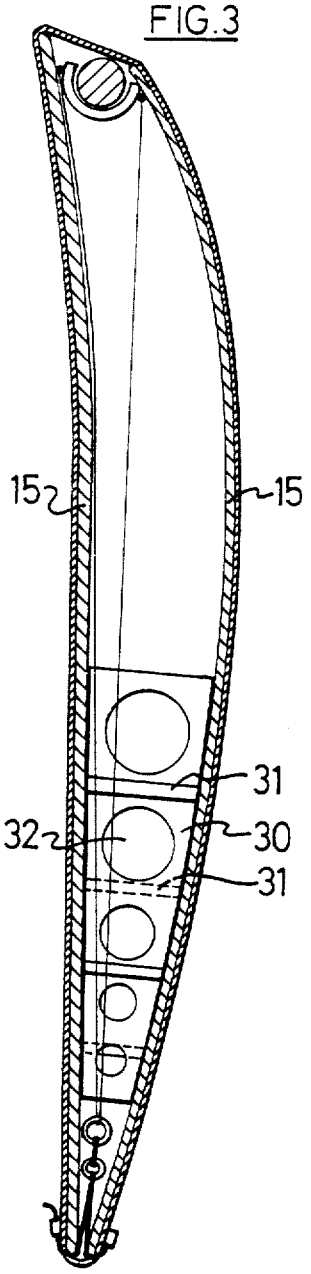

FIG. 3: shows a second sail of the present invention in plan view and in section.

Figure 4:
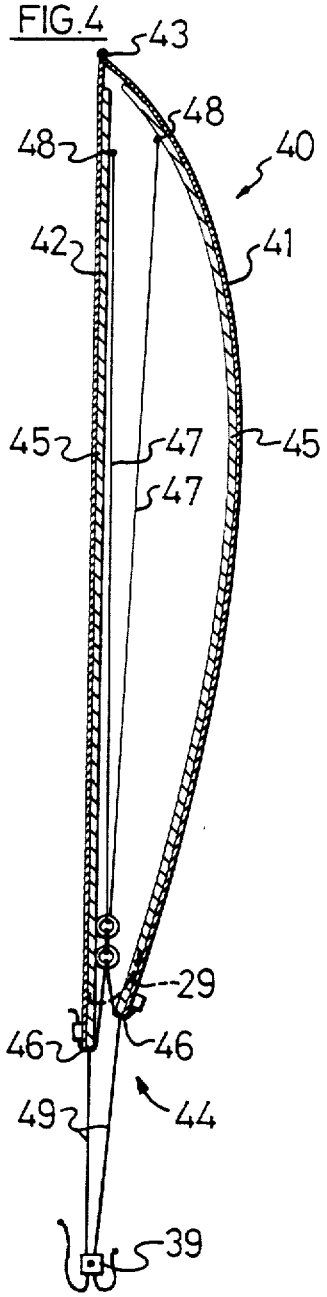

FIG. 4: shows a third sail of the present invention in plan view and in section.

Figure 5:
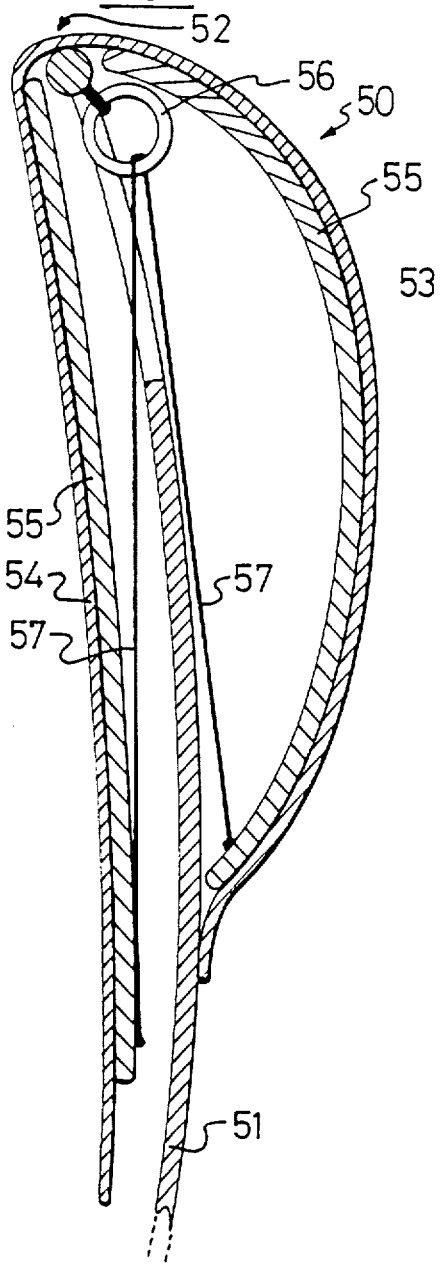

FIG. 5: shows a part of a fourth sail of the present invention in plan view and in section.

Figure 6:
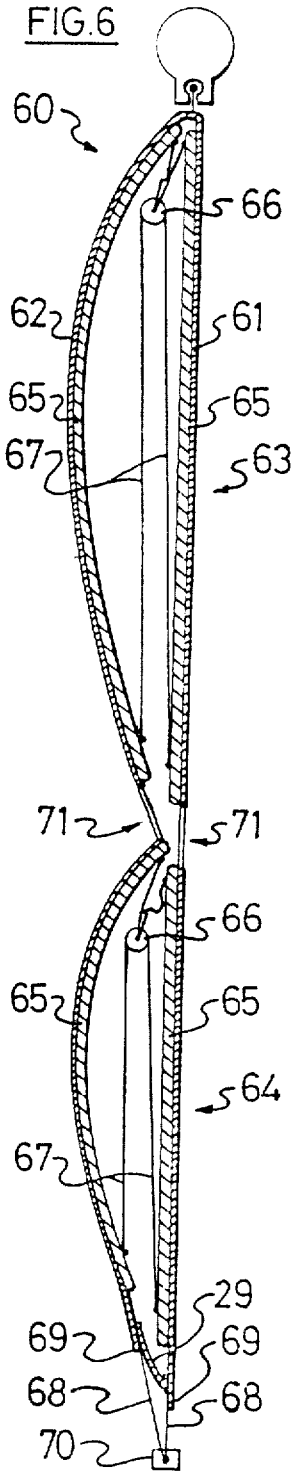

FIG. 6: shows a fifth sail of the present invention in plan view and in section.

Figure 7:
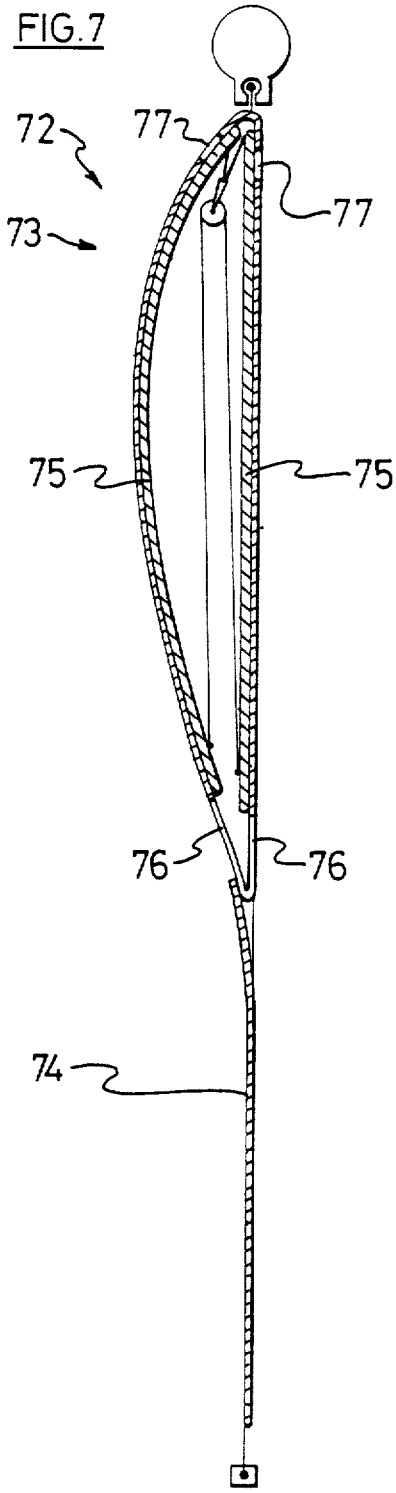

FIG. 7: shows a sixth sail of the present invention in plan view and in section.

A preferred embodiment of the present invention comprises a sail for windsurfers, having an aerofoil shape in normal use. Windsurfer sails differ from yacht sails not only in their shape and form, but also in their usage, and as a consequence different limitations and considerations apply to their construction.

Windsurfer sails are smaller, and the weight of the sail is of less importance than with a yacht sail. Further to this, a windsurfer sail does not need to be stored and unpacked quickly as in the case with yacht sails, which often need to be changed while the boat is in use, and bulk is less of a consideration because the sail does not need to be stowed on board as with yachts. The user of a windsurfer is not however free to perform complex operations on the sail when going about, or otherwise meeting new wind conditions, in the way that a yacht sailor can.

The preferred sail 10 of the present invention has two sheets 11 and 12 forming the outer aerofoil surface of the sail, joined along the front edge 13 and rear edge 14. Each of the sheets 11 and 12 is provided with a number of battens 15 extending across the sheet at intervals up the sail. The battens 15 are paired, i.e. each batten in the sheet 11 lies adjacent a corresponding batten in the sheet 12, and corresponding battens are of the same length.

The battens 15 are resilient and flexible, and are preferably held in pockets sewn into each of the sheets 11 and 12. Preferably they can be removed from the pockets in which they are held, to facilitate stowage of the sail.

Along the rear edge 14 of the sail, the two sheets 11 and 12 are simply sewn or otherwise fixed together, and the battens 15 preferably extend substantially all the way to the rear edge 14. Slits or holes may be provided along the rear edge to allow any water trapped between the sheets to drain out. Alternatively, a baffle 29 may be provided to interconnect the two sheets, as shown in FIG. 4 and FIG. 6, extending partway from clew to head. Preferably such a baffle extends up approximately 80% of the rear edge of the sail, leaving a gap at the top. The sheets are free to move slightly relative to one another in use, and avoid wrinkling. At the front edge 13, the two sheets 11 and 12 may alternatively not be fixed together along the rear edge 14, except by tensioning means as described below, such that the two sheets 11 and 12 are joined by an intermediate portion 16, which may in use form a part of either side of the sail. The intermediate portion may comprise a separate strip of fabric sewn to the front edge of each sheet, or may be a simple continuation of either or both sheets. The battens 15 do not extend across the portion 16.

In use, an aerofoil shape is created in the sail by tensioning the battens in one sheet such that they bow, and a bowed shape is created in the sheet as a consequence. In FIG. 1 and 2, sheet 11 is shown bowed, and sheet 12 unbowed, but the aerofoil shape of a sail of the present invention is reversible, such that sheet 11 could be unbowed and sheet 12 bowed, to suit sailing of the opposite tack. It will therefore be appreciated that references hereafter to 'the bowed sheet 11' or 'the unbowed sheet 12' will also apply to the other sheet when the sail is in the reverse configuration.

Tensioning of the battens 15 is achieved with the use of a line 17 passing along the inside of the sail 10, connected at points 18 to each of a pair of corresponding battens 15 substantially at the front edge 13 of the sail. The line 17 passes through a ring or pulley 19 fixed substantially near the rear edge 14 of the sail, which has means by which it may be moved closer to or further from the rear edge 14, as described below. Tension is applied to the line 17, such that it tends to pull the front ends of the battens 15 back towards the rear of the sail. This induces the battens 15 to bow.

If the line 17 were fixed in place at the rear of the sail, both battens would bow at substantially the same rate. However, because the line 17 passes through a ring or pulley 19 at the rear, through which it can move, it is possible for either batten to be bowed while the other is straight - the line 17 can be pulled out on one side, allowing one batten to straighten, and draw in on the other, causing the other batten to bow.

In use, with wind approaching the sail 10 from the direction of arrows W, the sheet 11 with associated battens 15 is pressed inwardly by the wind into a straightened position, causing the sheet 12 to be bowed more deeply outward. The front edge 13 of the sail is not directly attached to the mast 20, so the sheet 11 and associated battens 15 can extend beyond the front of the mast, as shown. Preferably a strut element illustrated in FIG. 2, is provided around or near the mast in association with each pair of battens, to in normal use prevent the front tip of a batten 15 from getting behind the mast 20 and becoming stuck there.

To prevent the sheet 11 bowing inwardly under wind pressure rather than lying substantially straight as shown, an internal barrier 21 may be used. This may comprise a third sheet between the sheets 11 and 12, but more preferably comprises a web of tapes 22, lines or similar, stretched between the clew 23, at the tip of the wishbone 24, and various points points on the mast 20. The tapes are preferably fixed at the clew 23 by being tied to or looped through a common ring, which in turn is fixed by a cord to the wishbone 24 at the rear edge 14 of the sail. When the sheet 11 is pushed inwardly by the wind, the battens 15 are pressed against the tapes 22 and are prevented from bowing inwardly.

An alternative system is shown in the embodiment of FIG. 3. Instead of the web of tapes 22, the internal barrier comprises a substantially flat plate 30 held between each pair of battens, preferably by fairly loose means such as straps or lines 31 across the internal cavity of the sail. Preferably the plate 30 is formed of a light and/or resilient material such as a closed cell foam plastic, and may be produced with one or more holes 32 to reduce weight. The plate 30 is preferably not directly fixed to one or both sides of the sail, such that one or both battens 15 can slide back or forwards relative to the plate 30 to some extent, to allow proper changing in sail shape when desired. By this means an internal space is maintained in the sail 10, and the sail has an aerodynamically efficient shape.

The tension on the line 17 may be varied to increase or decrease the amount or bow in the sheet 11. This is achieved with the use of a further ring or pulley 25 attached to the ring or pulley 19, and an adjustable strap 26 fixed to the rear edge 14 of the sail as shown. By tightening the strap 26, the ring or pulley 19 is pulled back, and the line 17 draws the front of the batten 15 back, increasing the depth of the bow in the sail.

An aperture 27 may be provided at or near the front edge 13 of the sail, by which air may enter and fill the internal air space of the sail. Outlet vents might also be provided at the rear of the sail, but this may not be necessary, particularly if the sheets 11 and 12 are not joined, or in part not joined along the rear edge 14. Further vents might also be provided to allow for the drainage of water from the internal airspace should the sail be immersed at some point.

Interconnecting lines 17 may be provided with each pair or battens 15, or possibly only with some or one pair. It should be noted that, while the lines are adjustable, there is no adjustment required during actual use—the sail will automatically switch from one configuration to the opposite configuration when the windsurfer goes about, and wind pressure acts on the other side of the sail. It may be necessary for the user to push the nearside sheet inwardly in light winds, but nothing more complex than this is required in using sails of the present invention.

It will be appreciated that sails of the present invention could be used on yachts, possibly with some modifications to shape and structure. Sails of this type are more preferably used on windsurfers, because their additional weight, bulk and rigidity may be found disadvantageous to some extent in a yachting application.

The following examples show sails of the present invention which might be used with yachts, or possibly with some modification, on windsurfers.

The embodiment shown in FIG. 4 preferably comprises a jib sail 40 having two sheets 41 and 42 forming the outer aerofoil surface of the sail, a front edge fastened in normal use to a forestay 43, and a rear or trailing edge 44 anchored in normal use by a tensioning system described below. Pairs of battens 45 are provided, one batten or each pair being associated with each sheet 41 and 42, and an interconnecting line 47 is connected at points 48 to each batten 45 of one or more such pairs. The line or lines 47 are tensioned by a ring and tensioning strap system as in the embodiments described above. The clew 46 at the rear of each sheet 41 and 42 is fastened by a line 49 to an anchoring point 39 either on the mast of the boat, or elsewhere on the boat if desired.

By shortening the length of one line 49 between a clew 46 and the anchoring point 39, the sheet 41 or 42 can be pulled taut (sheet 42 in FIG. 4). Similarly, slackening the line 49 on one side allows the sheet on that side to bow. When one sheet is pulled taut in this manner, the battens 45 associated with it are consequently pulled substantially straight, and this is normal use causes a reciprocal tendency in the battens 45 associated with the other sheet to bow. This is normal use can create an aerofoil shape.

It will be appreciated that substantially the same embodiment of the invention could be used as a mainsail for a yacht, with the front edge of the sail being adapted for connection to a mast, rather than to a forestay, and the anchoring point 39 being disposed at or towards the distal end of a boom.

Rather than two separate lines 49 as shown in FIG. 4, a single line could be used, attached at each end to the clews 46, and passing around a suitable anchoring point such as a pulley wheel, such that when one clew is pulled in toward the anchoring point, the other is automatically slackened off.

The embodiment shown in FIG. 5 may comprise a jib sail or possibly a spinnaker, and the features illustrated could also be used in a mainsail or a windsurfer sail, with some modifications. The sail 50 has a central, principal sheet 51, only part of which is shown in FIG. 5, which may be shaped and arranged in substantially the same way as a variety of known sails of the relevant type. The leading edge 52 of the sail is provided with an aerofoil shape, by means including an additional sheet 53 and 54 on each side of the principle sheet 51. Each of the sheets 53 and 54 is provided with battens 55 extending across the sheet at intervals up the sail, arranged in pairs as with the embodiments described above. A ring or pulley 56 is associated with one or more pairs, fixed at the leading edge 52 of the sail 50.

An interconnecting line 57 is fixed to the battens 55 at or near the rear; and passes through the ring or pulley 56 to bias the rear ends of the battens 55 forwardly. When air pressure or other means causes one sheet 53 or 54 to flatten against the principal sheet 51, the other is as a consequence bowed by the line 57, thereby creating an aerofoil shape at the leading edge of the sail 50.

The embodiment of the invention illustrated in FIG. 6 might be used as a mainsail as shown, or alternatively as a jib sail or some other sail.

The tensioning system used is similar to that illustrated in the embodiments of FIGS. 4 and 5.

The sail 60 is provided with two sheets 61 and 62, which in normal use form a forward aerofoil section 63 and a rearward aerofoil section 64. Each section 63 and 64 is provided with pairs of battens 65, and a forwardly disposed ring or pulley 66, through which an interconnecting line 67 operates in a manner similar to that in embodiments described above, to automatically bow one side of each section 63 and 64 when the other side is straightened.

The sheets 61 and 62 are preferably pulled straight by lines 68 extending from the clew 69 of each sheet to an anchoring point 70, in a manner equivalent to that described with reference to the embodiment of FIG. 4. Vents 71 are preferably provided in the sheets 61 and 62 between the two sections 63 and 64, to allow airflow from one side of the sail to the other, to in use act on the rearward aerofoil section 64.

The rings or pulleys 66 are preferably attached to the forward ends of the battens 65 as shown, although it will be appreciated that other arrangements are possible, including arrangements in which the rings or pulleys 66 are positioned at the rear of each section 63 and 64, and the lines 67 attach to the forward ends of the battens 65.

A further embodiment of the invention is illustrated in FIG. 7, comprising a mainsail 72 having a forward aerofoil section 73 and a trailing sheet 74. The aerofoil section 73 is provided with battens 75 and a tensioning system as in any of the embodiment described above. Vents 76 are preferably provided as shown at the rear of the aerofoil section 73, to firstly allow any water trapped between the sheets means to escape, and secondly to allow some airflow through the sail from the windward side to the leeward side so as to reduce turbulence across the leeward side of the trailing surface. As shown, vents 77 may optionally be provided at the front of the sail 72 to allow some airflow into the internal cavity of the aerofoil section 73.

It will be appreciated that a variety of modifications are possible to apparatus as described in the above examples, within the scope of the present invention. While it is preferable that the sides of the sail are made of sailcloth or similar supported on flexible and resilient battens, it may be possible for an arrangement to be made using a flexible and resilient sheet material, or possibly using cloth or similar alone with air pressure providing support. The shape of the sail and associated parts may be other than that shown, particularly if the present invention is applied to other types of sail.

The illustrated interconnection means might be altered within the scope of the invention. Instead of passing through a ring or pulley, the interconnecting line could be looped through a corresponding interconnecting line connected to the other ends of the battens. Similarly two lines might be provided which cross, such that each is connected to the forward end of one batten and the rearward end of the other. A range of other systems might also be used to provide the desired interaction between the surfaces of the aerofoil.

While the invention is described above with reference to sails having reversible camber, it will be appreciated that the systems described can provide an aerofoil structure which is evenly bowed outwardly on each side. Furthermore, the invented system might also be applied to aerofoil structures such as kites or hanggliders which do not in normal use reverse the camber of the aerofoil.

It will further be appreciated that a variety of other changes and modifications might be made in the above example, within the general scope of the present invention, which may be characterised by the following claims:

I claim:

1. A sail including two surfaces which in normal use form opposite faces of an aerofoil structure, each surface having resiliently flexible support means associated therewith, and interconnecting means interconnecting the two said surfaces at or about extremities of said support means, such that in normal use an increase in the distance between said extremities of support means associated with a first said surface by straightening of said first surface can cause by said interconnecting means a corresponding decrease in the distance between said extremities of support means associated with the second said surface, by bowing of said second surface; wherein said interconnecting means includes a line anchored at each end at or about corresponding extremities of said support means associated with each said surface, said line passing movably around an anchored retainer, such that in normal use when a first said surface is straightened, the length of line between said retainer and the end of the line anchored in association with support means for said first surface is increased, and the length of line between said retainer and the other end of the line anchored in association with support means for the second said surface is consequently decreased.

2. A sail is claimed in claim 1, wherein said resiliently flexible support means includes at least one elongate batten associated with each said surface, said at least one batten extending in normal use substantially horizontally behind each said surface.

3. A sail as claimed in claim 1 including means for limiting inward collapse of said aerofoil structure, including a structure interposed between said two surfaces to in normal use inhibit bowing of said surfaces inwardly.

4. A sail as claimed in claim 3, wherein said structure includes one or more bracing elements which in normal use brace one said surface against the other said surface, thereby holding them apart.

5. A sail as claimed in claim 3, wherein said structure includes a barrier between said two surfaces, to hold either said surface against movement across a border delineated by said barrier.

6. A sail as claimed in claim 5, wherein said barrier includes a web strung between said surfaces.

7. A sail as claimed in claim 5, wherein said barrier includes a sheet extending beyond one or more edges of said two surfaces, such that the total surface area of said sail is substantially greater than the area of said two surfaces.

8. A sail as claimed in claim 1 including means for straightening either said surface, including urging means acting on at least one extremity of said support means associated with each said surface, which can in normal use urge said extremity away from another extremity of said support means.

9. A sail as claimed in claim 8, wherein each said support means has a forward extremity and a rearward extremity, and wherein said forward extremity is anchored, and said urging means includes means for pulling said rearward extremity rearwards.

* * * * *